US009389528B2

(12) United States Patent
Kumai et al.

(10) Patent No.: US 9,389,528 B2
(45) Date of Patent: Jul. 12, 2016

(54) TONER FOR DEVELOPING ELECTROSTATIC IMAGES AND DEVELOPER

(71) Applicants: Mio Kumai, Shizuoka (JP); Hideki Sugiura, Shizuoka (JP)

(72) Inventors: Mio Kumai, Shizuoka (JP); Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/470,033

(22) Filed: Aug. 27, 2014

(65) Prior Publication Data

US 2015/0072286 A1 Mar. 12, 2015

(30) Foreign Application Priority Data

Sep. 6, 2013 (JP) ..... 2013-185439

(51) Int. Cl.
*G03G 9/087* (2006.01)
*G03G 9/08* (2006.01)

(52) U.S. Cl.
CPC ..... *G03G 9/08755* (2013.01); *G03G 9/0819* (2013.01); *G03G 9/0821* (2013.01); *G03G 9/0825* (2013.01); *G03G 9/08797* (2013.01)

(58) Field of Classification Search
CPC ..... G03G 9/0821; G03G 9/08728; G03G 9/08755; G03G 9/08797; G03G 9/08795
See application file for complete search history.

(56) References Cited

U.S. PATENT DOCUMENTS

2010/0310980 A1* 12/2010 Sugimoto ..... G03G 9/0804 430/108.2
2011/0144287 A1* 6/2011 Shindo ..... C08G 63/88 525/437
2011/0217646 A1* 9/2011 Shirai ..... G03G 9/087 430/109.4

FOREIGN PATENT DOCUMENTS

JP 2013-137420 7/2013

OTHER PUBLICATIONS

U.S. Appl. No. 14/338,614, filed Jul. 23, 2014 Inventor: Mizoguchi, et al.
U.S. Appl. No. 14/330,109, filed Jul. 14, 2014 Inventor: Sugiura, et al.

* cited by examiner

*Primary Examiner* — Peter Vajda
(74) *Attorney, Agent, or Firm* — Oblon, McClelland, Maier & Neustadt, L.L.P

(57) ABSTRACT

A toner includes an amorphous resin; and a crystalline polyester resin dispersed in the amorphous resin. The crystalline polyester resin has a volume-average particle diameter (Dv) of from 0.07 to 0.20 μm, and a ratio (Dv/Dn) of the volume-average particle diameter (Dv) to a number-average particle diameter (Dn) thereof of from 1.00 to 2.25.

18 Claims, No Drawings

TONER FOR DEVELOPING ELECTROSTATIC IMAGES AND DEVELOPER

CROSS-REFERENCE TO RELATED APPLICATIONS

This patent application is based on and claims priority pursuant to 35 U.S.C. §119 to Japanese Patent Application No. 2013-185439 filed on Sep. 6, 2013 in the Japan Patent Office, the entire disclosure of which is hereby incorporated by reference herein.

BACKGROUND

1. Technical Field

The present invention relates to a toner for developing electrostatic images and a developer.

2. Description of the Related Art

An image forming apparatus, such as an electrophotographic device, and an electrostatic recording device, an image is formed by developing a latent electrostatic image formed on a photoreceptor with a toner to form a toner image, transferring the toner image to a recording medium, such as paper, and then fixing the toner image with application of heat. To form a full-color image, typically four colors of the toners, black, yellow, magenta, and cyan, are used for developing, and toner images of these colors are transferred and superimposed on the recording medium, followed by fixing at once with application of heat.

For the purpose of reducing global environmental burden, low-temperature fixability is being needed. As a means of achieving this, a toner typically includes a crystalline polyester resin. However, it is not easy to uniformly disperse the crystalline polyester resin in a toner, and it is eccentrically located therein to cause unevenly-charged toner, resulting in scattering thereof in image forming apparatus. Further, it is preferable a toner quickly decreases its viscoelasticity is narrower temperature range to have low-temperature fixability. This sharp meltability causes deterioration of environmental stability such as temperature and humidity. A toner including a crystalline resin to have low-temperature fixability is difficult not to scatter and to have environmental stability.

SUMMARY

Accordingly, a need exist for a low-temperature fixable toner difficult to scatter, having high environmental stability.

Another object of the present invention is to provide a developer using the toner.

These objects and other objects of the present invention, either individually or collectively, have been satisfied by the discovery of a toner including an amorphous resin and a crystalline polyester resin dispersed in the amorphous resin, wherein the crystalline polyester resin has a volume-average particle diameter (Dv) of from 0.07 to 0.20 μm, and a ratio (Dv/Dn) of the volume-average particle diameter (Dv) to a number-average particle diameter (Dn) of from 1.00 to 2.25.

DETAILED DESCRIPTION

The present invention provides a low-temperature fixable toner difficult to scatter, having high environmental stability.

More particularly, the present invention relates to a toner including an amorphous resin a crystalline polyester resin dispersed in the amorphous resin, wherein the crystalline polyester resin has a volume-average particle diameter (Dv) of from 0.07 to 0.20 μm, and a ratio (Dv/Dn) of the volume-average particle diameter (Dv) to a number-average particle diameter (Dn) of from 1.00 to 2.25. This toner is difficult to scatter and has high environmental stability.

The mechanism is now being clarified, and from some of the analysis data, it is assumed as follows.

Different from a macro crystalline resin in a toner in conventional technologies, a micro crystalline polyester resin phase having a uniform size is present in a toner. Therefore, the crystalline polyester resin phase is independently present therein. The crystalline polyester resin phase is thought to be present in the shape of island in a sea of uniform amorphous resin phase.

This may be a copolymerizable resin including an amorphous resin site and a crystalline polyester resin site or a blended resin in which an amorphous resin and a crystalline polyester resin are melted and kneaded very well.

Not a sea-island form, a crystalline phase formed only of the crystalline polyester resin can be thought. However, it is very difficult to prevent individual crystalline resin phases from combining or growing even when a mixture of different kinds of the crystalline polyester resins is used.

The crystalline polyester resin phase present in the shape of island in a sea of the uniform amorphous resin phase is a typical example of the present invention.

Dv/Dn represents unevenness of dispersion diameter of the crystalline polyester resin in a toner. Dv represents a volume-average particle diameter of the crystalline polyester resin, and Dn represents a number-average particle diameter thereof. Having Dv/Dn of from 1.00 to 2.25, preferably not greater than 2.00, and more preferably not greater than 1.75, the crystalline polyester resin has a uniform dispersion diameter and is evenly charged. As a result, the toner scatters less.

Methods of controlling Dv/Dn includes controlling mixing conditions of the crystalline polyester resin and the amorphous resin as one of the methods. The resins are gradually dispersed evenly while mixed, but the crystalline polyester resin reaggregates after further mixed and the resins are unevenly dispersed again. Therefore, the mixing conditions need optimizing.

Namely, as one of methods of uniformly micro-dispersing the crystalline resin in a toner, it is important to control conditions of dispersing a material solution including an organic solvent, a colorant, an amorphous resin or its precursor, a crystalline resin or its precursor and a wax to prepare a pigment/wax dispersion.

Further, as another method of uniformly micro-dispersing the crystalline resin in a toner, it is effective to select the amorphous resin as well as the crystalline resin. Typically, resins having similar structures are known to have high affinity with each other. The crystalline resin and the amorphous resin have good affinity with each other, the crystalline resin is easy to uniformly disperse in the amorphous resin. Different plural crystalline resins tend to form a different crystal phase. Further, when a ratio of the crystalline resin to the amorphous resin is too high, the crystalline resin is difficult to uniformly disperse in the amorphous resin.

The volume-average particle diameter Dv of the crystalline polyester resin influences thermal properties of the resultant toner.

A cross-section of a toner is dyed with $OsO_4$ and a reflection electron image thereof is observed using a thermal FE-SEM to measure Dv of the crystalline polyester resin. The crystalline polyester resin promotes melting of the surrounded amorphous resin while melting itself. The smaller the Dv, the larger the surface area of the crystalline polyester resin contacting the amorphous resin, and the resultant toner increases in meltability. Namely, the toner lowers in hardness at a specific temperature. When Dv is not less than 0.07 μm, the surface area of the crystalline polyester resin contacting the amorphous resin is large, the resultant toner lowers in meltability. A toner preferably has high hardness because the contact area lowers and is not excessively charged even at low temperature and low humidity. When Dv is not greater than 0.20 μm, the surface area of the crystalline polyester resin contacting the amorphous resin is small, the resultant toner increases in meltability. A toner preferably has low hardness because the contact area increases and is sufficiently charged even at high temperature and high humidity. Methods of changing Dv include a method of changing the size of a nucleating agent. The larger the nucleating agent included in a toner, the larger the Dv. However, a pigment or a wax in a toner may serve as a nucleating agent, and a toner does not always need to include a nucleating agent.

The toner preferably has a ratio (Pv/Pn) of a volume-average particle diameter (Pv) to a number-average particle diameter (Pn) of from 1.00 to 1.28 because of preventing the toner from scattering. Pv/Pn represents unevenness of the toner particle diameter. When this is from 1.00 to 1.28, and more preferably to 1.20, the unevenness of the toner particle diameter is small and the particles are evenly charged to prevent the toner from scattering due to partial poorly-charged toner.

Further, the toner preferably has a spin-spin relaxation time (T2) of from 0.20 to 2.00 msec at 90° C. when subjected to Hahn echo method of NMR analysis to have high environmental stability. When T2 is not less than 0.20 msec, the toner is sufficiently charged even at high temperature and high humidity because of having high molecular mobility, low hardness and sufficient contact area. When not greater than 2.00 msec, the toner is not excessively charged even at low temperature and low humidity because of having low molecular mobility, high hardness and limited contact area.

In a dynamic viscoelasticity (temperature sweep (swept from 40° C.), frequency 1 Hz, distortion quantity control 0.1%, programming rate of 2° C./min), the toner preferably has a log G' of a storage elastic modulus (Pa) at 100° C. of from 3.5 to 4.5 to have low-temperature fixability. When not less than 3.5, the toner has good thermostable preservability even in high temperature environment. When not greater than 4.5, the toner melts well when fixed and is fixed at low temperature.

A two-component developer including the toner and a magnetic carrier has good toner fluidity, good developability and transferability, and high environmental stability (reliability).

(Average Dispersion Diameter of Crystalline Polyester Resin)

The volume-average particle diameter (Dv) and the number-average particle diameter (Dn) of the crystalline polyester resin in the toner of the present invention are measured by a shot key thermal FE-SEM Ultra55 from Zeiss.

The toner is buried in an epoxy resin and cut with an ultramicrotome ULTRA CUT UCT using a diamond knife from Leica to form a cross-section. Then, the toner is exposed to an osmium tetroxide ($OsO_4$) gas for 24 hrs to dye the crystalline polyester resin in the toner with $OsO_4$. The heavy element Os is detected as a white contrast by an atomic number effect of reflection electron image to see dispersion status of the crystalline polyester resin in the toner.

Only the crystalline polyester resin is known to be uniformly dyed with $OsO_4$ to have white contrast. When polyester having a crystalline structure is compared with polyester having no crystalline structure, only the polyester having a crystalline structure is dyed. Therefore, it is assumed $OsO_4$ selectively dyes the crystalline structure, physically adhering thereto, adsorbing thereto, combining therewith or chemically reacting therewith.

Ten (10) particles are measured by FE-SEM at an acceleration voltage of 0.8 kV, 5,000 times and 3 sight or more to obtain a reflection electron image. The reflection electron image is digitalized with an image analysis software LM eye from Lasertec Corp. to identify the crystalline resin with contrast.

Since an external additive may have a contrast similar to that of the crystalline polyester resin, only the maternal body of a toner is used. An equivalent circle diameter of the crystalline polyester resin is defined as D ($D_x$ is an equivalent circle diameter of the x th sample). The number-average particle diameter (Dn) and the volume-average particle diameter (Dv) of the crystalline polyester resin are determined by the following formulae (2) and (3), respectively. x is the number of the evaluated crystalline polyester resin.

$$Dn=(D_1+D_2+D_3+\ldots+D_x)/x \quad (2)$$

$$Dv=(D_1^4+D_2^4+D_3^4+\ldots+D_x^4)/(D_1^3+D_2^3+D_3^3+\ldots+D_x^3) \quad (3)$$

A principle of identifying the crystalline polyester resin from other components in a toner by this method is explained. First, a reflection electron, not a second electron, is analyzed to detect a difference of contrast between the crystalline polyester resin and the other components as an image by an atomic number effect of the reflection electron. The atomic number effect is an effect of detecting as a white contrast coming from a reflection electron increasing as the atomic number becomes larger.

$OsO_4$ selectively dyes the crystalline polyester resin. As a result, the crystalline resin is observed as a white contrast and the other toner parts are observed as gray or black contrasts. The acceleration voltage of 0.8 kV prevents a toner from charging up due to electron beam and makes electron beam analyze shallowly. The surface having a depth of form some nm to some ten nm can be analyzed, and the cross-section of a toner can be more precisely analyzed.

The volume-average particle diameter and the number-average diameter are measured Coulter Multisizer II from Coulter Electronics, Inc. under the following method.

0.1 to 5 ml of a non-ionic detergent polyoxyethylene alkylether is included as a dispersant in 100 to 150 ml of the electrolyte ISOTON-II from Coulter Scientific Japan, Ltd.;

2 to 20 mg of a toner sample is included in the electrolyte to be suspended therein, and the suspended toner is dispersed by an ultrasonic disperser from HONDA ELECTRONICS Co., Ltd. for about 1 to 3 min to prepare a sample dispersion liquid; and a volume and a number of the toner particles for each of the following 13 channels are measured by the above-mentioned measurer using an aperture of 100 μm to determine a volume distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 p.m. A particle diameter of the toner determined from this analysis is defined as P ($P_x$ is an equivalent circle diameter of the x th sample). The number-average particle diameter (Pn) and the volume-average particle diameter (Pv) of the toner are determined by the following formulae (4) and (5), respectively. x is the number of the evaluated crystalline polyester resin.

$$Pn=(P_1+P_2+P_3+\ldots+P_x)/x \quad (4)$$

$$Pv=(P_1^4+P_2^4+P_3^4+\ldots+P_x^4)(P_1^3+P_2^3+P_3^3+\ldots+P_x^3) \quad (5)$$

<Measurement of Toner Relaxation Time by Pulsed NMR>

In the present invention, physical properties of the toner are specified by the results of pulsed NMR (evaluations of spin-spin relaxation time (T2) and a proportion of a proton intensity of a soft component). Pulsed NMR of the toner is preferably performed in the following method.

The evaluations are performed by means of pulsed NMR, Minispec mq series, manufactured by Bruker Japan Co., Ltd. A high frequency magnetic field is applied to the toner inside the NMR tube, as a pulse, to thereby incline the magnetic vector, and mobility of molecules constituting the toner is evaluated from the time until x, and y components of the vector disappear (=relaxation time).

1) Sample

A toner (40 mg) is weighted and sampled in an NMR tube having a diameter of 10 mm, and then is used for a measurement.

2) Measuring Conditions

Hahn Echo Method

First 90° Pulse Separation: 0.01 msec

Final Pulse Separation: 20 msec

Number of Data Point for Fitting: 40 points

Cumulated number: 32 times

Temperature: 90° C.

3) Calculation Method of Spin-Spin Relaxation Time

From an easement curve obtained by the Hahn echo method of Pulsed NMR, the spin-spin relaxation time (T2) can be calculated by using exponential approximation of ORIGIN8.5 (produced by OriginLab Corporation). It has been known that the spin-spin relaxation time is shorter, as the molecular mobility is lower, and it is longer, as the molecular mobility is higher.

(Storage Modulus of Toner)

The storage modulus of a toner at 100° C. is measured by the following method.

1) Sample

A toner is pressed to have the shape of a tablet having a diameter of 10 mm and a thickness of 1 mm.

2) Measurer

The sample is fixed on a parallel plate of a dynamic viscoelasticity measurer ARES from TA Instruments and measured thereby.

3) Conditions

Temperature sweep (from 40° C.)

Frequency 1 Hz

Distortion quantity control 0.1%

Rate of temperature increase 2° C./min (Crystalline Polyester Resin)

In the present invention, it is preferred that the following crystalline polyester resin be contained. The melting point of the crystalline polyester resin is preferably in the range of 50° C. to 100° C., more preferably in the range of 55° C. to 90° C., and even more preferably in the range of 55° C. to 85° C. When the melting point thereof is 50° C. or higher, blocking of the stored toner does not occur, and storage stability of the toner or storage stability of the fixed image after fixing becomes excellent. When the melting point thereof is 100° C. or lower, sufficient low temperature fixing ability can be attained.

Note that, the melting point of the crystalline polyester resin is determined as peak temperature of an endothermic peak obtained by differential scanning calorimetry (DSC).

In the present invention, the "crystalline polyester resin" means a polymer (copolymer) obtained by polymerizing a component constituting polyester together with another component, as well as a polymer whose constitutional component is of 100% polyester structure. In the former case, however, another constitutional component, other than polyester constituting a polymer (copolymer), is 50% by weight or less.

The crystalline polyester resin for use in the toner of the present invention is synthesized, for example, from a polycarboxylic acid component, and a polyhydric alcohol component. Note that, in the present embodiment, the crystalline polyester resin may be a commercial product selected for use, or may be appropriately synthesized for use.

Examples of the polycarboxylic acid component include: aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid, such as dibasic acid (e.g., phthalic acid, isophthalic acid, terephthalic acid, naphthalene-2,6-dicarboxylic acid, malonic acid, and mesaconic acid); and anhydrides thereof and lower alkyl ester thereof. However, the examples are not limited to those listed above.

Examples of the tri or higher polycarboxylic acid include 1,2,4-benzenetricarboxylic acid, 1,2,5-benzenetricarboxylic acid, 1,2,4-naphthalenetricarboxylic acid, anhydrides thereof, and lower alkyl esters thereof. These may be used independently, or in combination.

Moreover, the acid component may contain, other than the aliphatic dicarboxylic acid or aromatic dicarboxylic acid, a dicarboxylic acid component having a sulfonic acid group. Furthermore, the acid component may contain, other than the aliphatic dicarboxylic acid or aromatic dicarboxylic acid, a dicarboxylic acid component having a double bond.

The polyhydric alcohol component is preferably aliphatic diol, more preferably straight-chain aliphatic diol, whose principle chain segment has 7 to 20 carbon atoms. In the case of branched-chain aliphatic diol, crystallinity of a resulting polyester resin is low, which may lower a melting point thereof. When the number of carbon atoms in the principle chain segment is less than 7, moreover, melting temperature is high in the case where it is condensation polymerized with aromatic dicarboxylic acid, and it may be difficult to achieve low temperature fixing ability. When the number thereof is greater than 20, it may be difficult to attain a material for practical use. The number of carbon atoms in the principle chain segment is preferably 14 or less.

Specific examples of the aliphatic diol suitably used for synthesis of the crystalline polyester for use in the present invention include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the examples are not limited those listed above.

Among them, 1,8-octanediol, 1,9-nonanediol, and 1,10-decanediol are preferable as they are readily available.

Examples of the trihydric or higher alcohol include glycerin, trimethylol ethane, trimethylol propane, and pentaerythritol. These may be used alone, or in combination.

An amount of the aliphatic diol in the polyhydric alcohol is preferably 80 mol % or greater, more preferably 90 mol % or greater. When the amount of the aliphatic diol is less than 80 mol %, crystallinity of the polyester resin may be low, which reduces the melting temperature. Therefore, the blocking resistance of the toner, image storage stability, and low temperature fixing ability may be degraded.

For the purpose of adjusting an acid value or hydroxyl value, polycarboxylic acid or polyhydric alcohol may be optionally added at the final stage of synthesis. Examples of the polycarboxylic acid include: aromatic carboxylic acid, such as terephthalic acid, isophthalic acid, phthalic anhydride, trimellitic anhydride, pyromellitic acid, and naphthalene dicarboxylic acid; aliphatic carboxylic acid, such as maleic anhydride, fumaric acid, succinic acid, alkenyl succinic anhydride, adipic acid; and alicyclic carboxylic acid, such as cyclohexane dicarboxylic acid.

Examples of the polyhydric alcohol include: aliphatic diol, such as ethylene glycol, diethylene glycol, triethylene glycol, propylene glycol, butanediol, hexanediol, neopentyl glycol, and glycerin; alicyclic diol, such as cyclohexane diol, cyclohexane dimethanol, and hydrogenated bisphenol A; and aromatic diol, such as bisphenol A ethylene oxide adduct, and bisphenol A propylene oxide adduct.

The production of the crystalline polyester resin can be performed at the polymerization temperature of 180° C. to 230° C. Optionally, the polymerization reaction is carried out with removing water or alcohol generated during condensation by reducing the pressure inside the system.

In the case where a polymerizable monomer is not dissolved or does not become compatible at the reaction temperature, the polymerizable monomer may be dissolved by adding a solvent having a high boiling point or a solubilizing agent. The polycondensation reaction is carried out while removing the solubilizing agent. In the case where there is a polymerizable monomer having poor compatibility in the copolymerization reaction, the polymerizable monomer having poor compatibility may be condensed with the polymerizable monomer, and acid or alcohol to be polycondensed in advance, and the resultant may be polycondensed with a main component.

The catalyst usable in the synthesis of the crystalline polyester resin includes: an alkali metal compound such as sodium, and lithium; an alkali earth metal compound such as magnesium, and calcium; a metal compound such as zinc, manganese, antimony, titanium, tin, zirconium, and germanium; and others such as a phosphorous acid compound, a phosphoric acid, and an amine compound.

Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl)phosphite, ethyltriphenyl phosphonium bromide, triethyl amine, and triphenyl amine.

The acid value ((the value (mg) of KOH necessary to neutralize 1 g of the resin) of the crystalline polyester resin for use in the present invention is preferably in the range of 3.0 to 30.0 mgKOH/g, more preferably in the range of 6.0 to 25.0 mgKOH/g, and even more preferably 8.0 to 20.0 mgKOH/g.

When the acid value is lower than 3.0 mgKOH/g, dispersibility thereof in water is low, and therefore it may be very difficult to produce particles by a wet production method. Moreover, stability as polymerized particles is significantly degraded during aggregation, and therefore it may be difficult to produce a toner efficiently. When the acid value is greater than 30.0 mgKOH/g, on the other hand, moisture uptake thereof as a toner increases, and therefore the toner may be easily influenced from the environment.

Moreover, the weight average molecular weight (Mw) of the crystalline polyester resin is preferably 6,000 to 35,000. When the weight average molecular weight (Mw) thereof is 6,000 or greater, the toner does not sink into a surface of a recording medium, such as paper, during fixing, and therefore uneven fixing does not occur. In addition, the strength or resistance of the toner against bending of the fixed image is not degraded. When the weight average molecular weight (Mw) thereof is 35,000 or less, the viscosity thereof during melting does not became excessively high, and therefore the temperature at which the crystalline polyester resin attains suitable viscosity for fixing is not high. Accordingly, low temperature fixing ability of the resulting toner is not degraded.

An amount of the crystalline polyester resin in the toner is preferable in the range of 10% to 85% by weight. When the amount of the crystalline polyester resin is less than 10% by weight, sufficient low temperature fixing ability may not be attained. When the amount thereof is greater than 85% by weight, sufficient toner strength or fixed image strength may not be attained, and an adverse effect may be provided to electrostatic propensity of the resulting toner.

The aforementioned crystalline resin containing the crystalline polyester resin preferably contains a crystalline polyester resin (may referred to "crystalline aliphatic polyester resin" hereinafter) synthesized using an aliphatic polymerizable monomer as a main component (50% by weight or greater). In this case, moreover, a proportion of the aliphatic polymerizable monomer constituting the crystalline aliphatic polyester resin is preferably 60 mol % or greater, more preferably 90 mol % or greater. As for the aliphatic polymerizable monomer, the aforementioned aliphatic diol or aliphatic acid can be suitably used.

(Amorphous Polyester Resin>>

In the present invention, the binder resin of the toner preferably contains at least the following amorphous polyester resin. As for the amorphous polyester resin, there are a modified polyester resin and an unmodified polyester resin. It is more preferred that the binder resin contain both a modified polyester resin and an unmodified polyester resin.

(Modified Polyester Resin)

In the present invention, the following modified polyester resin can be used as the polyester resin. For example, polyester prepolymer having an isocyanate group can be used.

Examples of the polyester prepolymer (A) having an isocyanate group include a compound obtained by further reacting polyester having an active hydrogen group, which is a polycondensation product of polyol (1) and polycarboxylic acid (2), with polyisocyanate (3). Examples of the active hydrogen group contained in the polyester include a hydroxyl group (e.g., an alcoholic hydroxyl group and a phenolic hydroxyl group), an amino group, a carboxyl group, and a mercapto group. Among them, an alcoholic hydroxyl group is preferable.

Examples of the polyol (1) include diol (1-1), and tri or higher polyol (1-2), and the polyol (1) is preferably (1-1) alone, or a mixture of (1-1) with a small amount of (1-2).

Examples of the diol (1-1) include alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexanedimethanol, and hydrogenated bisphenol A); bisphenols (e.g., bisphenol A, bisphenol F, and bisphenol S); alkylene oxide (ethylene oxide, propylene oxide, and butylene oxide) adduct of the alicyclic diol; and alkylene oxide (ethylene oxide, propylene oxide, and butylene oxide) adduct of the bisphenols. Among them, the diol is preferably C2-C12 alkylene glycol, or the alkylene oxide adduct of bisphenols, more preferably the alkylene oxide adduct of bisphenols, or a combination of the alkylene oxide adduct of bisphenols and the C2-C12 alkylene glycol. Examples of the tri or higher polyol (1-2) include tri- to octa- or higher polyhydric aliphatic alcohol (e.g., glycerin, trimethylol ethane, trimethylol propane, pentaerythritol, and sorbitol), tri or higher polyphenol (e.g., trisphenol PA, phenol novolak, and cresol novolak); and alkylene oxide adduct of the tri or higher polyphenol.

Examples of the polycarboxylic acid (2) include dicarboxylic acid (2-1), and tri- or higher polycarboxylic acid (2-2). The polycarboxylic acid (2) is preferably (2-1) alone, or a mixture of (2-1) with a small amount of (2-2). Examples of the dicarboxylic acid (2-1) include alkylene dicarboxylic acid (e.g., succinic acid, adipic acid, and sebacic acid), alkenylene dicarboxylic acid (e.g., maleic acid, and fumaric acid), and aromatic dicarboxylic acid (e.g., phthalic acid, isophthalic acid, terephthalic acid, and naphthalene dicarboxylic acid). Among them, preferred are C4-C20 alkenylene dicarboxylic acid, and C8-C20 aromatic dicarboxylic acid. Examples of the tri or higher polycarboxylic acid (2-2) include C9-C20 aromatic polycarboxylic acid (e.g., trimellitic acid, and pyromellitic acid). Note that, as for the polycarboxylic acid (2), acid anhydride or lower alkyl ester (e.g., methyl ester, ethyl ester, and isopropyl ester) of the above-listed polycarboxylic acid may be reacted with polyol (1).

A ratio of the polyol (1) to the polycarboxylic acid (2) is determined as an equivalent ratio [OH]/[COOH] of hydroxyl groups [OH] to carboxyl groups [COOH], which is typically 2/1 to 1/1, preferably 1.5/1 to 1/1, and more preferably 1.3/1 to 1.02/1.

Examples of the polyisocyanate (3) include aliphatic polyisocyanate (e.g., tetramethylene diisocyanate, hexamethylene diisocyanate, and 2,6-diisocyanate methyl caproate), alicyclic polyisocyanate (e.g., isophorone diisocyanate, and cyclohexylmethane diisocyanate), aromatic diisocyanate (e.g., tolylene diisocyanate, and diphenyl methane diisocyanate), aromatic aliphatic diisocyanate (e.g., $\alpha,\alpha,\alpha',\alpha'$-tetramethyl xylylene diisocyanate), isocyanurates, phenol derivatives of the polyisocyanate, the foregoing polyisocyanates blocked with oxime or caprolactam, and any combination of the foregoing polyisocyanates.

A ratio of the polyisocyanate (3) is determined as an equivalent ratio [NCO]/[OH] of isocyanate groups [NCO] to hydroxyl groups [OH] of the polyester having a hydroxyl group, which is typically 5/1 to 1/1, preferably 4/1 to 1.2/1, and more preferably 2.5/1 to 1.5/1.

When the ratio [NCO]/[OH] is greater than 5, low temperature fixing ability is degraded. When the molar ratio of [NCO] is less than 1, a urea content in the modified polyester becomes low, which leads to poor hot offset resistance.

An amount of the polyisocyanate (3) constituting component in the prepolymer having an isocyanate at a terminal thereof (A) is typically 0.5 to 40% by weight, preferably 1 to 30% by weight, and even more preferably 2 to 20% by weight. When the amount thereof is less than 0.5% by weight, hot offset resistance is degraded, and moreover it may not be able to realize both heat resistant storage stability and low temperature fixing ability. When the amount thereof is greater than 40% by weight, low temperature fixing ability is degraded.

The average number of isocyanate groups contained in the prepolymer having an isocyanate group (A) per molecule is typically 1 or more, preferably 1.5 to 3, and more preferably 1.8 to 2.5. When the average number thereof is less than 1 per molecule, a molecular weight of modified polyester after crosslinking and/or elongation becomes low, which may degrades hot offset resistance.

(Unmodified Polyester)

In the present invention, not only a solo use of the modified polyester (A), an unmodified polyester (C) is preferably contained as a toner binder component together with the modified polyester (A). Use of (C) in combination with (A) can improve glossiness, and gloss uniformity in the case where a resulting toner is used for a low temperature fixing and full-color image forming apparatus. Examples of (C) include a polycondensation product of the polyester component of (A), polyol (1) similar to those listed for use in (A), and polycarboxylic acid (2) similar to those listed for use in (A). Preferable examples thereof are also the same as in (A). Moreover, (C) may be not only the unmodified polyester, but also polyester modified with a chemical bond other than a urea bond, and for example, it may be modified with a urethane bond. It is preferred that (A) and (C) be at least partially compatible to each other in view of low temperature fixing ability and hot offset resistance. Accordingly, the polyester component of (A) and the composition of (C) are preferably similar. In the case where (A) is contained, a weight ratio of (A) to (C) is typically 5/95 to 75/25, preferably 10/90 to 25/75, more preferably 12/88 to 25/75, and particularly preferably 12/88 to 22/78. When the weight ratio of (A) is less than 5%, hot offset resistance may be degraded, and moreover it may not be able to attain both heat resistant storage stability and low temperature fixing ability.

A peak molecular weight of (C) is typically 1,000 to 30,000, preferably 1,500 to 10,000, and more preferably 2,000 to 8,000. When the peak molecular weight thereof is 1,000 or greater, heat resistant storage stability of a resulting toner is not degraded. When the peak molecular weight thereof is 10,000 or less, low temperature fixing ability is not degraded. A hydroxyl value of (C) is preferably 5 mgKOH/g or greater, more preferably 10 to 120 mgKOH/g, and even more preferably 20 to 80 mgKOH/g. Use of (C) having the hydroxyl value of 5 mgKOH/g or greater is advantageous for attaining both heat resistant storage stability and low temperature fixing ability. An acid value of (C) is typically 0.5 to 40 mgKOH/g, preferably 5 to 35 mgKOH/g. A toner tends to be negatively charged by imparting the acid value to the toner. When the acid value and the hydroxyl value are within the aforementioned ranges, respectively, a resulting toner is hardly influenced by the environment of high temperature high humidity, or low temperature low humidity, and therefore a resulting image is not deteriorated.

In the present invention, glass transition temperature (Tg) of the toner is typically 40 to 70° C., preferably 45 to 55° C. When it is 40° C. or higher, excellent heat resistant storage stability of a toner can be attained. When it is 70° C. or lower, sufficient low temperature fixing ability of a toner can be attained. As the toner of the present invention contains a cross-linked or elongated polyester resin together with other polyester, the toner of the present invention has excellent storage stability with low glass transition temperature, compared to a conventional polyester-based toner. As for the storage elastic modulus of the toner, the temperature (TG') at which the storage elastic modulus of the toner becomes 10,000 dyne/cm$^2$ with a measuring frequency of 20 Hz is typically 100° C. or higher, more preferably 110° C. to 200° C. When TG' is lower than 100° C., hot offset resistance is impaired. As for the viscosity of the toner, the temperature (T$\eta$) at which the viscosity of the toner becomes 1,000 Poise with a measuring frequency of 20 Hz is typically 180° C. or lower, preferably 90 to 160° C. When T$\eta$ is higher than 180°

C., low temperature fixing ability is impaired. Accordingly, TG' is preferably higher than Tη for attaining both low temperature fixing ability and hot offset resistance. In other words, a difference (TG'-Tη) between TG' and Tη is preferably 0° C. or higher, more preferably 10° C. or higher, and even more preferably 20° C. or higher. The upper limit of the difference is not particularly limited. Moreover, a difference between Tη and Tg is preferably 0 to 100° C. in view of attaining both heat resistant storage stability and low temperature fixing ability. The difference between $T_1$ and Tg is more preferably 10 to 90° C., and even more preferably 20 to 80° C.

(Crosslinking Agent and Elongation Agent)

In the present invention, amines can be used as a crosslinking agent and/or elongation agent. Examples of the amine (B) include diamine (B1), tri- or higher polyamine (B2), amino alcohol (B3), amino mercaptan (B4), amino acid (B5), and a blocked compound (B6) where an amino group of any of the foregoing B1 to B5 is blocked. Examples of the diamine (B1) include: aromatic diamine (e.g., phenylene diamine, diethyl toluene diamine, and 4,4'-diaminodiphenyl methane); alicyclic diamine (e.g., 4,4'-diamino-3,3'-dimethyldichlorohexyl methane, diamine cyclohexane, and isophorone diamine); and alicyclic diamine (e.g., ethylene diamine, tetramethylene diamine, and hexamethylene diamine). Examples of the tri- or higher polyamine (B2) include diethylene triamine, and triethylene tetramine. Examples of the amino alcohol (B3) include ethanol amine, and hydroxyethyl aniline. Examples of the amino mercaptan (B4) include aminoethylmercaptan, and aminopropylmercaptan. Examples of the amino acid (B5) include amino propionic acid, and amino caproic acid. Examples of the blocked compound (B6) where an amino group of any of the foregoing B1 to B5 include a ketimine compound and oxazoline compound obtained from the amines of (B1) to (B5) and ketones (e.g., acetone, methyl ethyl ketone and methyl isobutyl ketone). Among these amines (B), preferred are B1, and a mixture of B1 with a small amount of B2.

Moreover, a terminator is optionally used for the crosslink and/or elongation to adjust a molecular weight of a modified polyester after the reaction. Examples of the terminator include: monoamine (e.g., diethyl amine, dibutyl amine, butyl amine, and lauryl amine), and a blocked product thereof (e.g., a ketimine compound).

A ratio of the amine (B) is determined as an equivalent ratio [NCO]/[NHx] of isocyanate groups [NCO] in the prepolymer having an isocyanate group (A) to amino groups [NHx] in the amine (B), which is typically 1/2 to 2/1, preferably 1.5/1 to 1/1.5, and more preferably 1.2/1 to 1/1.2. When the ratio [NCO]/[NHx] is greater than 2, or less than ½, a molecular weight of the urea-modified polyester (i) becomes low, which leads to poor hot offset resistance.

(Colorant)

As for the colorant, any of conventional dyes and pigments can be used. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof.

An amount of the colorant is typically 1 to 15% by weight, and preferably 3 to 10% by weight, relative to the toner.

The colorant for use in the present invention may be used as a master batch in which the colorant forms a composite with a resin.

Examples of the binder resin kneaded in the production of, or together with the master batch include, other than the aforementioned modified or unmodified polyester resin, polymer of styrene or substitution thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone, or in combination.

The master batch can be prepared by mixing by applying high shear force and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

<Release Agent>

As for the release agent, common wax can be used. As for the wax, conventional wax can be used. Examples of the wax include: polyolefin wax (e.g., polyethylene wax, and polypropylene wax); long-chain hydrocarbon (e.g., paraffin wax, and Sasol wax); and carbonyl group-containing wax. Among them, preferred is carbonyl group-containing wax. Examples of the carbonyl group-containing wax include: polyalkanoic acid ester (e.g., carnauba wax, montan wax, trimethylol propane tribehenate, pentaerythritol tetrabehenate, pentaerythritol diacetate dibehenate, glycerin tribehenate, and 1,18-octadecanediol distearate); polyalkanol ester (e.g., tristearyl trimellitate, and distearyl maleate); polyalkanoic acid amide (e.g., ethylene diamine dibehenyl amide); polyalkyl amide (e.g., trimellitic acid tristearyl amide); and dialkyl ketone (e.g., distearyl ketone). Among them, preferred is polyalkanoic acid ester.

The melting point of the wax for use in the present invention is typically 40 to 160° C., preferably 50 to 120° C., and more preferably 60 to 90° C. The wax having a melting point of lower than 40° C. adversely affects heat resistant storage stability of a toner. The wax having a melting point of higher than 160° C. tends to cause cold offset during fixing performed at low temperature. Moreover, the melt viscosity of the wax is determined as a measured value at temperature higher than the melting point thereof by 20° C., which is preferably 5 to 1,000 cps, more preferably 10 to 100 cps. The wax having the melt viscosity of higher than 1,000 cps has a poor effect of improving hot offset resistance and low temperature fixing ability. An amount of the wax contained in the toner is typically 0 to 40% by weight, preferably 3 to 30% by weight.

(Charge Controlling Agent)

The toner of the present invention may optionally contain a charge controlling agent. As for the charge controlling agent, any of conventional charge controlling agents can be used. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

An amount of the charge controlling agent for use in the present invention is determined by a binder resin for use, presence of optionally used additives, and a production method of the toner including a dispersing method, and therefore cannot be determined unconditionally. However, the charge controlling agent is preferably used in an amount ranging from 0.1 to 10 parts by weight relative to 100 parts by weight of the binder resin. The amount thereof is preferably in the range of 0.2 to 5 parts by weight. When the amount thereof is greater than 10 parts by weight, the electrostatic propensity of the resulting toner is excessively large, and therefore an effect of the charge controlling agent is reduced and electrostatic force to a developing roller increases, which may reduce flowability of the toner, or reduce image density of images formed with the resulting toner. The charge controlling agent may be added by dissolving and dispersing after melting and kneading together with the master batch or the resin, or added by dissolving or dispersing directly in the organic solvent, or added by fixing on a surface of each toner particle after the preparation of the toner particles.

(External Additives)

As for external additives for assisting flowability, developing ability and charging ability of colored particles obtained in the present invention, other than oxide particles, inorganic particles or hydrophobic inorganic particles can be used in combination. It is preferred that the external additives contain at least one type of inorganic particles, which have been treated to give hydrophobicity, and have the average primary particle diameter of 1 to 100 nm, more preferably 5 to 70 nm. It is more preferred that the external additive contain at least one type of inorganic particles, which have been treated to give hydrophobicity, and have the average primary particle diameter of 20 nm or smaller, and at least one type of inorganic particles having the average primary particle diameter of 30 nm or greater.

Moreover, the BET specific surface area is preferably 20 to 500 $m^2/g$.

As for the external additives, any of conventional additives can be used as long as the conditions are met. For example, the external additives may contain silica particles, hydrophobic silica, fatty acid metal salt (e.g., zinc stearate, and aluminum stearate), metal oxide (e.g., titania, alumina, tin oxide, and antimony oxide), or fluoropolymer.

The particularly preferred additives include hydrophobic silica, titania, titanium oxide, and alumina particles. Examples of the silica particles include: HDK H 2000, HDK H 2000/4, HDK H 2050EP, HVK21, HDK H 1303 (all manufactured by Hoechst GmbH); R972, R974, RX200, RY200, R202, R805, R812 (all manufactured by Nippon Aerosil Co., Ltd.). Examples of the titania particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION). Particularly, examples of hydrophobic titanium oxide particles include: T-805 (manufactured by Nippon Aerosil Co., Ltd.); STT-30A, STT-65S—S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by Ishihara Sangyo Kaisha, ltd.).

In order to attain hydrophobic oxide particles, silica particles, titania particles, or alumina particles, hydrophilic particles are treated with a silane coupling agent, such as methyl trimethoxy silane, or methyl triethoxy silane.

Moreover, silicone oil-treated oxide particles or inorganic particles, which have been treated with silicone oil optionally by applying heat, are also suitable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acryl or methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride.

Among them, silica and titanium dioxide are particularly preferable.

An amount thereof is 0.1 to 5% by weight, preferably 0.3 to 3% by weight, relative to the toner. Examples of other polymeric particles include: polymer particles formed of soap-free emulsification polymerization, suspension polymerization, or dispersion polymerization, such as polystyrene, methacrylic acid ester copolymer, and acrylic ester copolymer; and polycondensation thermoset resin particles, such as silicone, benzoguanamine, and nylon.

(Fluidity Improver)

The fluidity improver is an agent used to perform a surface treatment to increase hydrophobicity, to thereby prevent degradations of flowability and charging properties of the toner in high humidity environments. For example, the preferable surface treating agent includes a silane coupling agent, a sililation agent, a silane-coupling agent containing a fluoroalkyl group, an organic titanate-based coupling agent, an aluminum-based coupling agent, silicone oil, and modified-silicone oil.

(Cleanability Improver)

The cleanability improver for removing a developer remained on a photoreceptor or primary transfer member after transferring includes, for example, metal salts of fatty acid such as stearic acid (e.g. zinc stearate, and calcium stearate); and polymer particles produced by soap-free emulsification polymerization, such as polymethyl methacrylate particles, and polystyrene particles. As for the polymer particles, preferred are those having a relatively narrow particle size distribution and the volume average particle diameter of 0.01 to 1 μm.

(Resin Particles)

In the present invention, resin particles are optionally added. The resin particles for use preferably have glass transition temperature (Tg) of 40 to 100° C., and the weight average molecular weight of 3,000 to 300,000. When the resin particles have the grass transition temperature (Tg) of lower than 40° C., and/or the weight average molecular weight of less than 3,000, the storage stability of the toner is impaired so that blocking may occur during storage or inside a developing device. When the resin particles have the glass transition temperature (Tg) of higher than 100° C., and/or the weight average molecular weight of greater than 300,000, the resin particles hinder a resulting toner from adhering to fixing paper, to thereby elevate the minimum fixing temperature.

The persistence of the resin particles on the toner particles is preferably 0.5 to 5.0% by weight. When the persistence is less than 0.5% by weight, the storage stability of the toner is impaired, and therefore blocking may occur during storage and inside a developing device. When the persistence is greater than 5.0% by weight, the resin particles hinder the wax from bleeding out, and therefore a releasing effect of the wax cannot be exhibited, to thereby cause offset.

The persistence of the resin particles can be determined by analyzing a substance, which is not originated from the toner particles but is originated from the resin particles, by a thermal decomposition gas chromatography weight spectrometer, and calculating from the obtained peak area.

As for a detector for the measurement, a weight spectrometer is preferable, but it is not limited to the weight spectrometer.

As for the resin particles, any resin can be used as long as it is a resin that can form an aqueous dispersion liquid, and the resin may be a thermoplastic resin, or a thermoset resin. Examples thereof include a vinyl-based resin, a polylactic acid resin, a polyurethane resin, an epoxy resin, a polyester resin, a polyamide resin, a polyimide resin, a silicon-based resin, a phenol resin, a melamine resin, a urea resin, an aniline resin, an ionomer resin, and a polycarbonate resin. As for the resin particles, two or more of the above-listed resin may be used without any problem. Among them, a vinyl-based resin, a polyurethane resin, an epoxy resin, and a polyester resin, and any combination thereof are preferable as an aqueous dispersion liquid of spherical resin particles thereof can be easily formed.

The vinyl-based resin is a polymer obtained through homopolymerization or copolymerization of a vinyl-based monomer. Examples thereof include a styrene-(meth)acrylic acid ester resin, a styrene-butadiene copolymer, a (meth) acrylic acid-acrylic acid ester polymer, a styrene-acrylonitrile copolymer, a styrene-maleic anhydride copolymer, and a styrene-(meth)acrylic acid copolymer.

The toner binder can be produced by the following method. Polyol (1) and polycarboxylic acid (2) are heated to the temperature ranging from 150 to 280° C. in the presence of a conventional esterification catalyst, such as tetrabutoxy titanate, and dibutyl tin oxide, optionally with removing generated water under the reduced pressure, to thereby obtain polyester having a hydroxyl group. Subsequently, the obtained polyester is allowed to react with polyisocyanate (3) at 40 to 140° C., to thereby obtain prepolymer having an isocyanate group (A).

The dry toner of the present invention can be produced by the following method, but the production method is not limited to the following method.

(Toner Production Method in Aqueous Medium)

The resin particles are preferably added to the aqueous phase used in the present invention in advance. The resin particles act as a particle size regulator, to surround toner particles, and eventually, the resin particles cover a surface of a toner particle and act as a shell layer. Precise control and adjustments are important to impart a sufficient function as a shell layer, as it is influenced by a particle size of the resin particles, a composition of the resin particle, a dispersant (surfactant) and a solvent for use in the aqueous phase.

Water used for the aqueous phase may be water alone, or may be a combination of water and a solvent miscible with water.

Examples of the solvent miscible with water include alcohol (e.g., methanol, isopropanol, ethylene glycol), dimethylformamide, tetrahydrofuran, cellosolve (e.g., methyl cellosolve), and lower ketone (e.g., acetone, and methyl ethyl ketone).

The toner particles are obtained by reacting dispersed element, which have been prepared by dissolving or dispersing the polyester prepolymer having an isocyanate group (A) in an organic solvent, with the amine (B) in the aqueous phase, to thereby form toner particles. Examples of a method for stably forming dispersed element formed of the polyester prepolymer (A) in the aqueous phase include a method containing adding a toner raw material composition, which has been prepared by dissolving or dispersed the polyester prepolymer (A) in an organic solvent, to the aqueous phase, and dispersing the mixture by applying shearing force. The polyester prepolymer (A) dissolved or dispersed in the organic solvent, and other materials in the toner composition (may be referred to as "toner raw materials" hereinafter), such as a colorant, colorant master batch, releasing agent, charge controlling agent, and unmodified polyester resin, may be mixed when dispersed elements are formed in the aqueous phase, but it is preferred that the toner raw materials be mixed in advance, followed by dissolving or dispersing the mixture in an organic solvent, and the resulting mixture be added to and dispersed in an aqueous phase. In the present invention, moreover, other toner raw materials, such as a colorant, releasing agent, and charge controlling agent, are not necessarily mixed when particles are formed in the aqueous phase. They may be added after forming particles. For example, after forming particles which do not contain a colorant, a colorant can be added by a conventional dying method.

A method of dispersing is not particularly limited, but any conventional system, such as a low-speed shearing disperser, a high-speed shearing disperser, a friction disperser, a high-pressure jetting disperser and an ultrasonic wave disperser, can be used. Among them, the high-speed shearing disperser is preferable, because it can control the particle diameters of the dispersed elements to the range of 2 to 20 μm. In the case where the high-speed shearing disperser is used, the rotating speed is not particularly limited, but it is typically 1,000 to 30,000 rpm, preferably 5,000 to 20,000 rpm. The dispersion time is not particularly limited, but it is typically 0.1 to 5 minutes in case of a batch system. The temperature during the dispersing is typically 0 to 150° C. (under the pressure), preferably 40 to 98° C. The higher temperature is preferable, as the viscosity of the dispersed element formed of the polyester prepolymer (A) is low, and dispersing is easily carried out.

An amount of the aqueous phase used relative to 100 parts by weight of a toner composition containing the polyester prepolymer is typically 50 to 2,000 parts by weight, preferably 100 to 1,000 parts by weight. When the amount thereof is less than 50 parts by weight, the dispersed state of the toner composition is poor and therefore toner particles having the predetermined particle size cannot be attained. When the amount thereof is greater than 2,000 parts by weight, it is not economical. Moreover, a dispersing agent can be optionally used.

Use of the dispersing agent is preferable, as a particle size distribution of resulting toner particles becomes sharp, and a dispersion becomes stable.

Examples of the dispersing agent for dispersing and emulsifying the oil phase, in which the toner composition has been dispersed, in the aqueous phase include: anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

Also, a fluoroalkyl group-containing surfactant can exhibit its dispersing effects even in a small amount. Preferable examples of the fluoroalkyl group-containing anionic surfactant include fluoroalkyl carboxylic acid having 2 to 10 carbon atoms and metal salts thereof, disodium perfluorooctanesulfonylglutamate, sodium 3-[ω-fluoroalkyl(C6-C11)oxy)-1-alkyl(C3-C4)sulfonate, sodium 3-[ω-fluoroalkanoyl(C6-C8)-N-ethylamino]-1-propanesulfonate, fluoroalkyl(C11-C20) carboxylic acid and metal salts thereof, perfluoroalkylcarboxylic acid(C7-C13) and metal salts thereof, perfluoroalkyl(C4-C12)sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin and monoperfluoroalkyl(C6-C16) ethylphosphate.

Examples of the commercial product thereof include: SURFLON S-111, S-112, S-113 (all manufactured by Asahi Glass Co., Ltd.); FLUORAD FC-93, FC-95, FC-98, FC-129 (all manufactured by Sumitomo 3M Limited); UNIDYNE DS-101, DS-102 (all manufactured by DAIKIN INDUSTRIES, LTD.); MEGAFAC F-110, F-120, F-113, F-191, F-812, F-833 (all manufactured by DIC Corporation); EFTOP EF-102, 103, 104, 105, 112, 123A, 123B, 306A, 501, 201, 204, (all manufactured by Mitsubishi Materials Electronic Chemicals Co., Ltd.); and FUTARGENT F-100, F150 (all manufactured by NEOS COMPANY LIMITED).

Examples of the cationic surfactant include fluoroalkyl group-containing primary, secondary or tertiary aliphatic compounds, aliphatic quaternary ammonium salts (e.g., perfluoroalkyl (C6-C10) sulfonamide propyltrimethyl ammonium salts), benzalkonium salts, benzetonium chloride, pyridinium salts and imidazolinium salts. Examples of the commercial product thereof include: SURFLON S-121 (manufactured by Asahi Glass Co., Ltd.); FLUORAD FC-135 (manufactured by Sumitomo 3M Limited); UNIDYNE DS-202 (manufactured by DAIKIN INDUSTRIES, LTD.); MEGAFAC F-150, F-824 (all manufactured by DIC Corporation); EFTOP EF-132 (manufactured by Mitsubishi Materials Electronic Chemicals Co., Ltd); and FUTARGENT F-300 (manufactured by NEOS COMPANY LIMITED).

Moreover, a water-insoluble inorganic compound dispersing agent, such as tricalcium phosphate, calcium carbonate, titanium oxide, colloidal silica, and hydroxyapatite, can also be used as the dispersing agent.

Moreover, dispersed droplets may be stabilized with polymer protective colloids. Examples thereof include: acid, such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic-based monomer, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide; ester formed between vinyl alcohol and a compound containing a carboxyl group. such as vinyl acetate, vinyl propionate and vinyl butyrate; acrylamide, methacrylamide, diacetone acrylamide and a methylol compound of thereof; acid chlorides, such as acrylic acid chloride and methacrylic acid chloride; homopolymer or copolymer containing a nitrogen atom or nitrogen-containing heterocyclic ring, such as vinyl pyridine, vinyl pyrrolidone, vinyl imidazole and ethyleneimine; polyoxyethylene, such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters; and cellulose, such as methyl cellulose, hydroxyethyl cellulose and hydroxypropyl cellulose.

In the case where calcium phosphate or the like that is soluble in acid and alkali is used as a dispersion stabilizer, the calcium phosphate is dissolved by acid such as hydrochloric acid, followed by washing with water, to thereby remove the calcium phosphate from the particles. Alternatively, it can be removed by decomposition using enzyme.

In the case where the dispersing agent is used, the dispersing agent may be left on surfaces of the toner particles, but the dispersing agent is preferably removed by washing after the elongation and/or crosslink reaction in view of charging ability of a resulting toner.

The duration of the elongation and/or crosslink reaction is selected, for example, depending on reactivity between the isocyanate group structure contained in the prepolymer (A) for use and the amine (B) for use, but it is typically 10 minutes to 40 hours, preferably 2 to 24 hours. The reaction temperature is typically 0 to 150° C., preferably 40 to 98° C. Moreover, a conventional catalyst may be used, if necessary. Specific examples of the catalyst include dibutyl tin laurate, and dioctyl tin laurate.

In order to remove the organic solvent from the obtained emulsified dispersion liquid, employed can be a method where the entire liquid is gradually heated to completely evaporate and remove the organic solvent contained in the dispersed droplets. It is also possible that the emulsified dispersion liquid is sprayed in a dry atmosphere to completely evaporate and remove the water-insoluble organic solvent in the droplets to thereby form toner particles, at the same time as evaporating and removing the aqueous dispersant. As for the dry atmosphere in which the emulsified dispersion liquid is sprayed, heated gas (e.g., air, nitrogen, carbon dioxide and combustion gas), especially, gas flow heated to temperature equal to or higher than the boiling point of the solvent for use, is generally used. The treatment of a short period by a spray dryer, a belt dryer or a rotary kiln can sufficiently provide the intended quality.

A method for removing the organic solvent, the organic solvent can be removed by blowing air by a rotary evaporator or the like.

Thereafter, rough separation was performed by centrifugal separation, the obtained emulsified dispersed element are washed in a washing tank, and the resultant is dried by a hot air drier. This series of the processes is performed, followed by removing the solvent, and drying, to thereby obtain toner base particles.

Thereafter, the toner base particles are preferably subjected to maturing. Preferably, the toner base particles are matured at 30 to 55° C. (more preferably 40 to 50° C.), for 5 to 36 hours (more preferably 10 to 24 hours).

In the case where a particle size distribution is wide during emulsifying and dispersing, and the resultant is washed and dried with maintaining such particle size distribution, the toner base particles can be subjected to classification to control the particle size distribution thereof to the intended particle size distribution.

The classification may be carried out in a liquid by removing small particles by cyclone, a decanter, or centrifugal separator. Of course, the classification can be performed on particles after drying and collecting as a powder. The classification performed in a liquid is preferable in view of its efficiency. The obtained waste fine particles or coarse particles are returned again to the kneading process to be used for formation of particles. At this time, waste fine particles or coarse particles may be in a wet state.

The used dispersing agent is preferably removed from the obtained dispersion liquid as much as possible, which is preferably performed at the same time as the aforementioned classification.

The obtained dried toner powder may be mixed together with different particles, such as releasing agent particles, charge controlling agent particles, flow improving agent particles, and colorant particles, or mechanical impact is applied to mixed powder to fix or fuse the different particles on surfaces of the toner particles. As a result, the different particles can be prevented from falling off from the surfaces of the obtained composite particles.

As for a specific method thereof, there are: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board. Examples of a device used for this method include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

Finally, external additives, such as inorganic particles, and the toner are mixed by HENSCHEL MIXER, and coarse particles are removed by ultrasonic wave sieve, to thereby obtain a toner, as a final product.

(Two-Component Developer)

The two-component developer of the present invention contains the toner of the present invention, and a magnetic carrier. In the case where the toner of the present invention is used for a two-component developer, the toner can be mixed with a magnetic carrier. As for the blending ratio of the carrier and the toner in the developer, an amount of the toner is preferably 1 to 10 parts by weight relative to 100 parts by weight of the carrier. The magnetic carrier can be selected from conventional magnetic carrier such as iron powder, ferrite powder, magnetite powder and magnetic resin carrier each having a particle diameter of about 20 to 200 μm.

As for a coating material for the carrier, an amino-based resin has been known. Examples of the amino-based resin include a urea-formaldehyde resin, a melamine resin, a benzoguanamine resin, a urea resin, a polyamide resin, and an epoxy resin. Other examples of the coating material include: a polyvinyl-based resin and a polyvinylidene-based resin, such as an acrylic resin, a polymethyl methacrylate resin, a polyacrylonitrile resin, a polyvinyl acetate resin, a polyvinyl alcohol resin, and a polyvinyl butyral resin; a polystyrene-based resin such as a polystyrene resin, and a styrene-acryl copolymer resin; a halogenated olefin resin such as polyvinyl chloride; a polyester-based resin such as a polyethylene terephthalate resin, and a polybutylene terephthalate resin; a polycarbonate-based resin; and others such as a polyethylene resin, a polyvinyl fluoride resin, a polyvinylidene fluoride resin, a polytrifluoroethylene resin, a polyhexafluoropropylene resin, a copolymer of vinylidene fluoride and acryl monomer, a copolymer of vinylidene fluoride and vinyl fluoride, fluoroterpolymer (e.g. a terpolymer of tetrafluoroethylene, vinylidene fluoride, and non-fluoride monomer), and a silicone resin. Moreover, the resin coating may contain electroconductive powder, if necessary. As for the electroconductive powder, metal powder, carbon black, titanium oxide, tin oxide and zinc oxide can be used. The average particle diameter of the conductive powder is preferably 1 μm or smaller.

When the average particle diameter thereof is larger than 1 μm, it may be difficult to control the electric resistance.

The toner of the present invention can be used as a one-component magnetic toner or non-magnetic toner without a carrier.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Evaluation Device)

As an evaluation device, a modified image forming apparatus (imagio MP C6000, manufactured by Ricoh Company Limited) in which a modification had been made mainly in a fixing section, was used. The linear velocity thereof was set to 350 mm/sec. Moreover, a fixing unit of the fixing section was adjusted to have fixing contact pressure of 30 N/cm$^2$, and fixing nip time of 30 ms. As for a surface of a fixing medium, a tetrafluoroethylene-perfluoroalkylvinyl ether copolymer resin (PFA) was applied, and shaped, and a surface thereof was adjusted. The resultant was used as the surface of the fixing medium.

(Evaluation of Two-Component Developer)

In the case where an image evaluation was performed with a two-component developer, a developer was prepared using a ferrite carrier having the average particle diameter of 35 μm, which had been coated with a silicone resin in the average thickness of 0.5 μm as described below, by homogeneously mixing and charging 7 parts by weight of the toner of each color with 100 parts by weight of the carrier in a tubular mixer that was a type where a container thereof was rolled to stir the contents.

(Production of Carrier)

| Core material | |
|---|---|
| Mn ferrite particles (weight average particle diameter 35 μm) | 5,000 |
| **Coating materials** | |
| Toluene | 450 |
| Silicone resin SR2400 (manufactured by Dow Corning Toray Co., Ltd., nonvolatile component: 50% by weight) | 450 |
| Aminosilane (SH6020, manufactured by Dow Corning Toray Co., Ltd.) | 10 |
| Carbon black | 10 |

The above-listed coating materials were dispersed by a stirrer for 10 minutes to prepare a coating liquid. A coating device was charged with the prepared coating liquid and the core material to coat the core material with the coating liquid. The coating device was configured to perform coating by forming a rotational flow of the coating liquid and the core material in the fluid bed, to which a rotational bottom plate disk, and a stirring blade had been provided. The obtained coated product was baked at 250° C. for 2 hours in an electric furnace, to thereby obtain the carrier.

Example 1

Synthesis of Resin Particle Emulsion

A reaction vessel equipped with a stirring bar and a thermometer was charged with 683 parts by weight of water, 11 parts by weight of sodium salt of sulfuric acid ester of methacrylic acid-ethylene oxide adduct (ELEMINOL RS-30, manufactured by Sanyo Chemical Industries, Ltd.), 10 parts by weight of polylactic acid, 60 parts by weight of styrene, 100 parts by weight of methacrylic acid, 70 parts by weight of butyl acrylate, and 1 part by weight of ammonium persulfate, and the resulting mixture was stirred for 30 minutes at 3,800 rpm, to thereby obtain a white emulsion. The obtained emulsion was heated until the internal system temperature reached 75° C., and was allowed to react for 4 hours. Subsequently, a 1% by weight aqueous ammonium persulfate solution (30 parts) was added to the reaction mixture, followed by aging for 6 hours at 75° C., to thereby prepare Resin Particle Dispersion Liquid 1, which was an aqueous dispersion liquid of a vinyl resin (a copolymer of styrene/methacrylic acid/butyl acrylate/sodium salt of sulfuric acid ester of methacrylic acid ethylene oxide adduct). Part of Particle Dispersion Liquid 1 was dried to separate a resin component.

—Preparation of Aqueous Phase—

Water (990 parts by weight), 83 parts by weight of Particle Dispersion Liquid 1, 37 parts by weight of a 48.5% sodium dodecyl diphenyl ether disulfonate aqueous solution (ELEMINOL MON-7, manufactured by Sanyo Chemical Industries, Ltd.), and 90 parts by weight of ethyl acetate were mixed together and stirred, to thereby obtain a milky white fluid, which was used as Aqueous Phase 1.

—Synthesis of Non-Crystalline Intermediate Polyester—

A reaction vessel equipped with a cooling tube, a stirrer, and a nitrogen-inlet tube was charged with 1,176 parts by weight of bisphenol A ethylene oxide (2 mol) adduct, 140 parts by weight of bisphenol A propylene oxide (2 mol) adduct, 488 parts by weight of terephthalic acid, 38 parts by weight of trimellitic anhydride, and 4 parts by weight of dibutyl tin oxide, and the resulting mixture was allowed to react for 7 hours at 230° C. under the atmospheric pressure, and further reacted for 5 hours under the reduced pressure of 10 mmHg to 15 mmHg, to thereby obtain Intermediate Polyester 1. Next, a reaction vessel equipped with a cooling tube, a stirrer, and a nitrogen-inlet tube was charged with 1,845 parts by weight of Intermediate Polyester 1, 405 parts by weight of isophorone diisocyanate, and 2,000 parts by weight of ethyl acetate, and the resulting mixture was allowed to react for 5 hours at 100° C., to thereby obtain Prepolymer 1.

—Synthesis of Ketimine—

A reaction vessel equipped with a stirring bar and a thermometer was charged with 57 parts by weight of isophorone diamine, and 25 parts by weight of methyl ethyl ketone, and the mixture was allowed to react for 4 and a half hours at 50° C., to thereby obtain Ketimine Compound 1.

—Synthesis of Amorphous Polyester Resin—

A reaction vessel equipped with a stirring bar and a thermometer was charged with 2,250 parts by weight of Prepolymer 1, 70 parts of Ketimine Compound 1, and 2,500 parts of ethylacetate, and the mixture was stirred for 2 hours at 80° C. and de-solvented for 8 hours at 30° C., to thereby obtain Amorphous Polyester Resin 1.

—Synthesis of Crystalline Polyester Resin—

A reaction vessel equipped with a cooling tube, a stirrer, and a nitrogen-inlet tube was charged with 1,200 parts by weight of 1,6-hexanediol, 1,200 parts by weight of decanedioic acid, 0.4 parts by weight of dibutyl tin oxide serving as a catalyst. Thereafter, the air inside the vessel was turned into an inert atmosphere with nitrogen gas by decompression, and the mixture in the vessel was mechanically stirred for 4 hours at 180 rpm. Thereafter, the resultant was heated to 210° C. under the reduced pressure, followed by stirring for 1.5 hours. Once the mixture became viscous, the mixture was air-cooled to stop the reaction, to thereby obtain Crystalline Polyester 1.

—Preparation of Polyester Resin including Composite of Amorphous Site and Crystalline Site—

A reaction vessel equipped with a cooling tube, a stirrer, and a nitrogen-inlet tube was charged with 2,250 parts by weight of the Amorphous Polyester Resin 1, 250 parts of the Crystalline Polyester 1, and 2,000 parts of ethylacetate, and the mixture was stirred for 5 hours at 100° C. and de-solvented for 8 hours at 30° C., to thereby obtain Polyester Resin including Composite of Amorphous Site and Crystalline Site (Copolymer 1).

—Synthesis of Masterbacth 1 (MB1)—

Five hundred (500) parts by weight of water, 50 parts by weight of carbon black (Printex 35 JY-C-32 particle size 24 nm from Evonik Degussa GmbH, and 450 parts by weight of the Polyester Resin including Composite of Amorphous Site and Crystalline Site (Copolymer 1) were mixed in HENSCHEL MIXER from Mitsui Mining Co., Ltd. The obtained mixture was kneaded by a two-roll mill at 110° C. for 1 hr, extended with pressure, cooled, and pulverized by a pulverizer, to thereby produce Masterbatch 1 (MB1).

—Preparation of Oil Phase (Pigment-Wax Dispersion)—

A vessel equipped with a stirring bar and a thermometer was charged with 1,900 parts by weight of the Polyester Resin including Composite of Amorphous Site and Crystalline Site, 120 parts by weight of paraffin wax, and 947 parts by weight of ethylacetate, and the resulting mixture was heated to 80° C. with stirring. The temperature was kept at 80° C. for 5 hours, followed by cooling the mixture to 30° C. in 1 hour. Next, the vessel was further charged with 500 parts by weight of the Masterbatch 1 (MB1), and 500 parts by weight of ethylacetate, and the resulting mixture was mixed for 1 hour, to thereby obtain a Raw Material Solution 1.

The Raw Material Solution 1 (1,324 parts by weight) was transferred to another vessel, and the carbon black and wax therein were dispersed by means of a bead mill (ULTRA VISCOMILL, manufactured by AIMEX CO., Ltd.) under the conditions: a liquid feed rate of 1.5 kg/hr, disk circumferential velocity of 3 m/sec, 0.5 mm-zirconia beads packed to 80% by volume, and 2 passes (Oil Phase Preparation Conditions 1 [refer to Table 1]), to thereby obtain Pigment-Wax Dispersion 1, i.e., Oil Phase 1.

TABLE 1

| -Emulsification and Removal of Solvent- | |
|---|---|
| Oil Phase Preparation Conditions 1 | liquid feed rate of 1.5 kg/hr, disk circumferential velocity of 3 m/sec, 0.5 mm-zirconia beads packed to 80% by volume, and 2 passes |
| Oil Phase Preparation Conditions 2 | liquid feed rate of 1 kg/hr, disk circumferential velocity of 6 m/sec, 0.5 mm-zirconia beads packed to 80% by volume, and 3 passes |
| Oil Phase Preparation Conditions 3 | liquid feed rate of 0.5 kg/hr, disk circumferential velocity of 8 m/sec, 0.5 mm-zirconia beads packed to 80% by volume, and 5 passes |
| Oil Phase Preparation Conditions 4 | Bead mill (ULTRA VISCOMILL from AIMEX CO., Ltd. under the conditions: a liquid feed rate of 2.0 kg/hr, disk circumferential velocity of 1.5 m/sec, 0.5 mm-zirconia beads packed to 80% by volume, and 1 pass |

A vessel was charged with 749 parts by weight of Pigment-Wax Dispersion 1, i.e., Oil Phase 1, and which was mixed by TK Homomixer from PRIMIX Corp. at 5,000 rpm for 5 minutes. To the vessel, 1,200 parts by weight of Aqueous Phase 1 was added, and the resulting mixture was mixed by TK Homomixer at 10,000 rpm for 1.5 hours, to thereby obtain Emulsified Slurry 1.

A vessel equipped with a stirrer and a thermometer was charged with Emulsified Slurry 1, and the solvent therein was removed at 30° C. for 8 hours, followed by maturing at 50° C. for 72 hours, to thereby obtain Dispersion Slurry 1.

—Washing and Drying—

After filtering 100 parts by weight of Dispersion Slurry 1 under the reduced pressure, the following series of operations (1) to (4) was performed twice, to thereby obtain Filtration Cake 1.

(1): To the filtration cake, 100 parts by weight of ion-exchanged water was added, and the mixture was mixed (at 12,000 rpm for 10 minutes) by the TK Homomixer, followed by filtering the mixture.

(2): To the filtration cake obtained in (1), 100 parts by weight of a 10% by weight sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by weight of 10% by weight hydrochloric acid was added, and the mixture was mixed (at 12,000 rpm for 10 minutes) by the TK Homomixer, followed by filtering the mixture.

(4): To the filtration cake obtained in (3), 300 parts by weight of ion-exchanged water was added, and the mixture was mixed (at 12,000 rpm for 10 minutes) by the TK Homomixer, followed by filtering the mixture.

Filtration Cake 1 was dried with an air-circulating drier for 48 hours at 45° C., and was then passed through a sieve with a mesh size of 75 μm, to thereby prepare Toner Base Particles 1.

Thereafter, 100 parts by weight of Toner Base Particles 1 and 1 part of hydrophobic silica having a diameter of 13 nm were mixed by HENSCHEL MIXER, to thereby obtain a Toner 1. The method of preparing the Toner 1 is shown in Table 2, the properties thereof are presented in Table 3, and the evaluation results thereof are presented in Table 4.

Example 2

The procedure for preparation of the Toner 1 in Example 1 was repeated except for using an Oil Phase 2 with the following Masterbacth 2 (MB2) to prepare a Toner 2. The method of preparing the Toner 2 is shown in Table 2, the properties thereof are presented in Table 3, and the evaluation results thereof are presented in Table 4.

—Synthesis of Masterbacth 2 (MB2)—

Five hundred (500) parts by weight of water, 50 parts by weight of carbon black (Printex 35 JY-C-32 particle size 24 nm from Evonik Degussa GmbH, 25 parts by weight of a nucleating agent NA-11 from ADEKA CORP. and 425 parts by weight of the Polyester Resin including Composite of Amorphous Site and Crystalline Site (Copolymer 1) were mixed in HENSCHEL MIXER from Mitsui Mining Co., Ltd. The obtained mixture was kneaded by a two-roll mill at 110°

C. for 1 hr, extended with pressure, cooled, and pulverized by a pulverizer, to thereby produce Masterbatch 2 (MB2).

Example 3

The procedure for preparation of the Toner 1 in Example 1 was repeated except for using the following Oil Phase 3 i.e., a Pigment-Wax Dispersion 3 to prepare a Toner 3. The method of preparing the Toner 3 is shown in Table 2, the properties thereof are presented in Table 3, and the evaluation results thereof are presented in Table 4.

—Preparation of Oil Phase (Pigment-Wax Dispersion)—

The Raw Material Solution 1 (1,324 parts by weight) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 3 passes (Oil Phase Preparation Conditions 2), to thereby obtain Pigment-Wax Dispersion 3, i.e., Oil Phase 3.

Example 4

The procedure for preparation of the Toner 1 in Example 1 was repeated except for using the following Oil Phase 4. i.e., a Pigment-Wax Dispersion 4 to prepare a Toner 4. The method of preparing the Toner 4 is shown in Table 2, the properties thereof are presented in Table 3, and the evaluation results thereof are presented in Table 4.

—Preparation of Oil Phase (Pigment-Wax Dispersion)—

The Raw Material Solution 1 (1,324 parts by weight) was transferred to another vessel, and the carbon black and wax therein were dispersed by means of a bead mill (ULTRA VISCOMILL, manufactured by AIMEX CO., Ltd.) under the conditions: a liquid feed rate of 0.5 kg/hr, disk circumferential velocity of 8 m/sec, 0.5 mm-zirconia beads packed to 80% by volume, and 5 passes (Oil Phase Preparation Conditions 3), to thereby obtain Pigment-Wax Dispersion 4, i.e., Oil Phase 4.

Example 5

The procedure for preparation of the Toner 1 in Example 1 was repeated except for using Oil Phase 5 with the MB2 under the conditions of Oil Phase Preparation Conditions 3 to prepare a Toner 5. The method of preparing the Toner 5 is shown in Table 2, the properties thereof are presented in Table 3, and the evaluation results thereof are presented in Table 4.

Example 6

Synthesis of Amorphous Polyester Resin 2

An autoclave reaction tank equipped with a thermometer, a stirrer and a nitrogen-inlet tube was charged with 3 parts by weight of 1,3-propanediol, 450 parts by weight of L-lactide, 50 parts of D-Lactide and 2 parts by weight of tin 2-ethylhexanoate, and the mixture was subject to a ring-opening polymerization at 160° C. under normal pressure for 3 hrs, and further reacted at 130° C. under normal pressure.

The resultant resin was cooled to have a room temperature, and pulverized to obtain polyester diol including a polyhydroxycarboxylic acid skeleton, having a hydroxyl value of 11.2.

Four hundred (400) parts by weight of the polyester diol including a polyhydroxycarboxylic acid skeleton and 100 parts by weight of polyester diol having a hydroxyl value of 56, which was obtained by subjecting a bisphenol A EO 2-mol adduct and a terephthalic acid to a dehydration condensation at a molar ratio of 1/1, were dissolved in methyl ethyl ketone, followed by an elongation reaction with 20 parts by weight of IPDI at 50° C. for 6 hrs, and removal of the solvent to prepare an Amorphous Polyester Resin 2.

—Synthesis of Crystalline Polyester Resin 2—

A 4-neck round-bottom flask having a capacity of 5 L with a thermometer, a stirrer, a condenser and a nitrogen-inlet tube was charged with 100 parts by weight of a composition including acidic components and alcoholic components (fumaric acid:succinic acid: trimellitic acid anhydride: 1,4-butanediol=90.0:4.5:5.5:100.0 (weight ratio)) and 0.1 parts by weight of hydroquinone. The flask was set on a mantle heater and heated while a nitrogen gas was introduced therein through the nitrogen-inlet tube to keep an inactive atmosphere therein. The mixture was reacted at 160° C. for 5 hrs, 200° C. for 1 hr, and 8.3 kPa for 1 hr to obtain Crystalline Polyester Resin 2.

—Melting and Kneading→Pulverizing—

Sixty-three (63) parts by weight of the Amorphous Polyester Resin 2, 30 parts by weight of the Crystalline Polyester Resin 2, 2 parts by weight of carbon black (Printex 35 JY-C-32 particle size 24 nm from Evonik Degussa GmbH), 5 parts by weight of carnauba wax, and 2 parts by weight of N,N'-ethylene-bisstearic acid amide were mixed in HENSCHEL MIXER.

The resultant toner material mixture was melted and kneaded in a biaxial extruder at 90° C. for 4 hrs (Kneading Conditions 1) to prepare a Melted and Kneaded Mixture (Kneaded Mixture 1).

The Melted and Kneaded Mixture (Kneaded Mixture 1) was cooled at 10° C./h and pulverized in a counter jet mill.

The pulverized material was classified in a rotary classifier and a toner excessively pulverized was removed to prepare toner base particles 6.

One hundred (100) parts by weight of the toner base particles 6 and 1 part of the hydrophobized silica having a particle diameter of 13 nm were mixed in HENSCHEL MIXER to prepare a Toner 6. The method of preparing the Toner 6 is shown in Table 2, the properties thereof are presented in Table 3, and the evaluation results thereof are presented in Table 4.

Example 7

The procedure for preparation of the Toner 6 in Example 6 was repeated except for using the following Melted and Kneaded Mixture (Kneaded Mixture 2) to prepare a Toner 7. The method of preparing the Toner 7 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-124 particle size 12 nm from Evonik Degussa GmbH), 5 parts by weight of carnauba wax, and 2 parts by weight of N,N'-ethylene-bisstearic acid amide were mixed in HENSCHEL MIXER.

The resultant toner material mixture was melted and kneaded in a biaxial extruder at 90° C. for 6 hrs (Kneading Conditions 2) to prepare a Melted and Kneaded Mixture (Kneaded Mixture 2).

Example 8

The procedure for preparation of the Toner 6 in Example 6 was repeated except for using the following Melted and Kneaded Mixture (Kneaded Mixture 3) to prepare a Toner 8.

The method of preparing the Toner 8 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-C32 particle size 24 nm from Evonik Degussa GmbH), 5 parts by weight of carnauba wax, and 2 parts by weight of N,N'-ethylene-bisstearic acid amide were mixed in HENSCHEL MIXER.

The resultant toner material mixture was melted and kneaded in a biaxial extruder at 90° C. for 6 hrs (Kneading Conditions 3) to prepare a Melted and Kneaded Mixture (Kneaded Mixture 3).

Example 9

The procedure for preparation of the Toner 6 in Example 6 was repeated except for using the following Melted and Kneaded Mixture (Kneaded Mixture 3) to prepare a Toner 9. The method of preparing the Toner 9 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-C32 particle size 24 nm from Evonik Degussa GmbH), 5 parts by weight of carnauba wax, and 2 parts by weight of N,N'-ethylene-bisstearic acid amide were mixed in HENSCHEL MIXER.

The resultant toner material mixture was melted and kneaded in a biaxial extruder at 90° C. for 8 hrs (Kneading Conditions 4) to prepare a Melted and Kneaded Mixture (Kneaded Mixture 4).

TABLE 2-1

| | | Polymerization Toner | | | |
|---|---|---|---|---|---|
| | | Oil Phase | MB | Binder | Oil Phase Preparation Conditions |
| Example 1 | Toner 1 | 1 | MB1 | Copolymer 1 | 1 |
| Example 2 | Toner 2 | 2 | MB2 | *Copolymer 2 | 1 |
| Example 3 | Toner 3 | 1 | MB1 | Copolymer 1 | 2 |
| Example 4 | Toner 4 | 1 | MB1 | Copolymer 1 | 3 |
| Example 5 | Toner 5 | 1 | MB1 | Copolymer 1 | 3 |
| Comparative Example 1 | Toner 10 | 3 | MB3 | Copolymer 1 | 2 |
| Comparative Example 2 | Toner 11 | 3 | MB3 | Copolymer 1 | 1 |
| Comparative Example 3 | Toner 12 | 1 | MB1 | Copolymer 1 | 4 |

TABLE 2-2

| | | Pulverization Toner | | |
|---|---|---|---|---|
| | | Kneaded Mixture | Binder | Kneading Conditions |
| Example 6 | Toner 6 | 1 | C PE2, A PE2 | 1 |
| Example 7 | Toner 7 | 2 | C PE2, A PE2 | 2 |
| Example 8 | Toner 8 | 3 | C PE2, A PE2 | 3 |
| Example 9 | Toner 9 | 1 | C PE2, A PE2 | 3 |
| Comparative Example 4 | Toner 13 | 4 | C PE2, A PE2 | 4 |
| Comparative Example 5 | Toner 14 | 5 | *C PE2, A PE2 | 1 |

TABLE 2-2-continued

| | | Pulverization Toner | | |
|---|---|---|---|---|
| | | Kneaded Mixture | Binder | Kneading Conditions |
| Comparative Example 6 | Toner 15 | 6 | *C PE2, A PE2 | 2 |

*Nucleating agent was used.
C PE: Crystalline polyester
A PE: Amorphous polyester

Comparative Example 1

The procedure for preparation of the Toner 1 in Example 1 was repeated except for using the following Masterbacth 3 to prepare an Oil Phase 6 and the Oil Phase Preparation Conditions 2, to prepare a Toner 10. The method of preparing the Toner 10 is shown in Table 2, the properties thereof are presented in Table 3, and the evaluation results thereof are presented in Table 4.

—Synthesis of Masterbacth 3 (MB3)—

Five hundred (500) parts by weight of water, 50 parts by weight of carbon black (Printex 35 JY-124 particle size 12 nm from Evonik Degussa GmbH, and 450 parts by weight of the Polyester Resin including Composite of Amorphous Site and Crystalline Site (Copolymer 1) were mixed in HENSCHEL MIXER from Mitsui Mining Co., Ltd. The obtained mixture was kneaded by a two-roll mill at 110° C. for 1 hr, extended with pressure, cooled, and pulverized by a pulverizer, to thereby produce Masterbatch 3 (MB3).

Comparative Example 2

The procedure for preparation of the Toner 1 in Example 1 was repeated except for using the following Masterbacth 3 to prepare an Oil Phase 7, to prepare a Toner 11. The method of preparing the Toner 11 is shown in Table 2, the properties thereof are presented in Table 3, and the evaluation results thereof are presented in Table 4.

Comparative Example 3

The procedure for preparation of the Toner 1 in Example 1 was repeated except for using the following Oil Phase 8 to prepare a Toner 12. The method of preparing the Toner 12 is shown in Table 2, the properties thereof are presented in Table 3, and the evaluation results thereof are presented in Table 4.

The Raw Material Solution 1 (1,324 parts by weight) was transferred to another vessel, and the carbon black and wax therein were dispersed by means of a bead mill (ULTRA VISCOMILL, manufactured by AIMEX CO., Ltd.) under the conditions: a liquid feed rate of 2.0 kg/hr, disk circumferential velocity of 1.5 msec, 0.5 mm-zirconia beads packed to 80% by volume, and 1 pass (Oil Phase Preparation Conditions 4 [refer to Table 1]), to thereby obtain Oil Phase 8.

Comparative Example 4

The procedure for preparation of the Toner 6 in Example 6 was repeated except for using the following Melted and Kneaded Mixture (Kneaded Mixture 4) to prepare a Toner 13. The method of preparing the Toner 13 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-C-32 particle size 24 nm from Evonik Degussa GmbH), 5 parts by weight of carnauba wax, and 2 parts by weight of N,N'-ethylene-bisstearic acid amide were mixed in HENSCHEL MIXER.

The resultant toner material mixture was melted and kneaded in a biaxial extruder at 90° C. for 2 hrs (Kneading Conditions 4) to prepare a Melted and Kneaded Mixture (Kneaded Mixture 4).

Comparative Example 5

The procedure for preparation of the Toner 6 in Example 6 was repeated except for using the following Melted and Kneaded Mixture (Kneaded Mixture 5) to prepare a Toner 14. The method of preparing the Toner 14 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-C-32 particle size 24 nm from Evonik Degussa GmbH), 5 parts by weight of carnauba wax, 2 parts by weight of a nucleating agent NA-11 from ADEKA CORP. and 2 parts by weight of N,N'-ethylene-bisstearic acid amide were mixed in HENSCHEL MIXER.

The resultant toner material mixture was melted and kneaded in a biaxial extruder at 90° C. for 4 hrs (Kneading Conditions 1) to prepare a Melted and Kneaded Mixture (Kneaded Mixture 5).

Comparative Example 6

The procedure for preparation of the Toner 6 in Example 6 was repeated except for using the following Melted and Kneaded Mixture (Kneaded Mixture 5) to prepare a Toner 15. The method of preparing the Toner 15 is shown in Table 2, the properties thereof are presented in Table 3, and the evaluation results thereof are presented in Table 4.

Sixty-three (63) parts by weight of the Amorphous Polyester Resin 2, 30 parts by weight of the Crystalline Polyester Resin 2, 2 parts by weight of carbon black (Printex 35 JY-C-32 particle size 24 nm from Evonik Degussa GmbH), 5 parts by weight of carnauba wax, 2 parts by weight of a nucleating agent NA-11 from ADEKA CORP. and 2 parts by weight of N,N'-ethylene-bisstearic acid amide were mixed in HENSCHEL MIXER.

The resultant toner material mixture was melted and kneaded in a biaxial extruder at 90° C. for 6 hrs (Kneading Conditions 2) to prepare a Melted and Kneaded Mixture (Kneaded Mixture 5).

(Evaluation Items)

1) Toner Scattering

After 30,000 images of a chart having an image area of 7% were continuously produced on plain papers TYPE 6200 from Ricoh Company, Ltd., toner contamination in the image forming apparatus was visually observed to classify the contamination to the following 4 grades.

Excellent: No contamination

Good: Almost no contamination

Fair: Contaminated, but practically usable

Poor: Badly contaminated, and unusable

2) Environmental Stability 2-1) In Environment of High Temperature and High Humidity After 200 images of a chart having an image area of 7% were continuously produced on plain papers TYPE 6200 from Ricoh Company, Ltd. at 55° C. and 70% RH, 10 solid images were produced to count the number of blank spots. The less, the better.

Excellent: No blank spot

Good: Almost no blank spot

Fair: 1 to 2 blank spots

Poor: 3 or more blank spots 2-2) In Environment of Low Temperature and Low Humidity Two thousand (2,000) solid images were produced on plain papers TYPE 6200 from Ricoh Company, Ltd. at 15° C. and 10% RH, and the image density of the 10th image and that of the 2,000$^{th}$ image were compared with a spectrodensitometer from X-Rite, Inc. The less the difference, the better.

Excellent: The difference was less than 0.1%

Good: The difference was not less than 0.1% and less than 0.2%

Fair: The difference was not less than 0.2% and less than 0.3%

Poor: The difference was not less than 0.3%

3) Heat Resistant Storage Stability

A 50 mL glass container was filled with each toner, and retained in a thermostatic bath of 50° C. for 24 hours. The toner was cooled to 24° C., and the penetration (mm) of the toner was measured according to penetration test (JISK2235-1991). Evaluation results of the penetration based on the following grades are shown in Table 4. The larger the value of penetration, the better the heat resistant storage stability. When the penetration would be less than 5 mm, a problem would probably arise during use.

Excellent: Penetration was not less than 20 mm

Good: Penetration was not less than 10 mm and less than 20 mm

Fair: Penetration was not less than 5 mm and less than 10 mm.

Poor: Penetration was less than 5 mm.

4) Low-Temperature Fixability

A solid image was formed on a thick transfer sheet (photocopy paper <135> manufactured by Ricoh Company Limited) with a toner deposition amount of 0.85±0.1 mg/cm$^2$, and subjected to a fixing test by varying the temperature of the fixing belt. The solid image was formed at a position of 3.0 cm from a sheet feeding direction leading end of the sheet.

A picture was drawn on the obtained fixed image with a drawing tester under a load of 50 g, and the temperature of the fixing roller, the image fixed at which temperature was hardly scraped off, was determined as the minimum fixing temperature. Evaluation results based on the following grades are shown in Table 4.

Excellent: lower than 120° C.

Good: 120° C. or higher and lower than 130° C.

Fair: 130° C. or higher and lower than 140° C.

Poor: 140° or higher

TABLE 3

| | Dv/Dn | Dv (μm) | Pv/Pn | T2 (msec) | Log G' |
|---|---|---|---|---|---|
| Example 1 | 2.25 | 0.07 | 1.31 | 2.31 | 3.3 |
| Example 2 | 2.15 | 0.13 | 1.30 | 1.63 | 3.7 |
| Example 3 | 1.20 | 0.08 | 1.13 | 2.20 | 3.4 |
| Example 4 | 1.84 | 0.09 | 1.22 | 2.11 | 3.4 |
| Example 5 | 1.71 | 0.13 | 1.22 | 1.81 | 3.4 |
| Example 6 | 2.23 | 0.19 | 1.29 | 0.18 | 5.2 |
| Example 7 | 1.31 | 0.14 | 1.16 | 0.84 | 3.9 |
| Example 8 | 1.22 | 0.2 | 1.14 | 0.16 | 5.2 |
| Example 9 | 1.70 | 0.18 | 1.26 | 0.19 | 5.1 |
| Comparative Example 1 | 1.34 | 0.06 | 1.15 | 2.97 | 3.3 |
| Comparative Example 2 | 2.11 | 0.05 | 1.31 | 3.14 | 3.3 |
| Comparative Example 3 | 2.37 | 0.08 | 1.33 | 2.16 | 3.4 |

TABLE 3-continued

| | Dv/Dn | Dv (μm) | Pv/Pn | T2 (msec) | Log G' |
|---|---|---|---|---|---|
| Comparative Example 4 | 2.38 | 0.19 | 1.33 | 0.18 | 5.2 |
| Comparative Example 5 | 2.00 | 0.21 | 1.31 | 0.16 | 5.5 |
| Comparative Example 6 | 1.43 | 0.22 | 1.16 | 0.14 | 5.6 |

TABLE 4

| | Scattering | Blank Spots (HH) | Image Density (LL) | Heat Resistant Storage Stability | Low-Temperature Fixability |
|---|---|---|---|---|---|
| Example 1 | Fair | Excellent | Fair | Good | Excellent |
| Example 2 | Fair | Good | Good | Excellent | Excellent |
| Example 3 | Good | Excellent | Fair | Good | Excellent |
| Example 4 | Good | Excellent | Fair | Good | Excellent |
| Example 5 | Good | Good | Good | Excellent | Excellent |
| Example 6 | Fair | Fair | Excellent | Excellent | Good |
| Example 7 | Excellent | Good | Good | Excellent | Excellent |
| Example 8 | Good | Fair | Excellent | Excellent | Good |
| Example 9 | Good | Fair | Excellent | Excellent | Good |
| Comparative Example 1 | Fair | Excellent | Poor | Good | Excellent |
| Comparative Example 2 | Fair | Excellent | Poor | Good | Excellent |
| Comparative Example 3 | Poor | Excellent | Fair | Good | Excellent |
| Comparative Example 4 | Poor | Fair | Excellent | Excellent | Good |
| Comparative Example 5 | Fair | Poor | Excellent | Excellent | Good |
| Comparative Example 6 | Fair | Poor | Excellent | Excellent | Good |

HH: High temperature high humidity
LL: Low temperature low humidity

Having now fully described the invention, it will be apparent to one of ordinary skill in the art that many changes and modifications can be made thereto without departing from the spirit and scope of the invention as set forth therein.

What is claimed is:

1. A toner, comprising:

an amorphous resin; and a crystalline polyester resin dispersed in the amorphous resin, wherein the crystalline polyester resin is present in a micro crystalline polyester resin phase, and wherein the crystalline polyester resin has a volume-average particle diameter (Dv) of from 0.07 to 0.20 μm, and a ratio (Dv/Dn) of the volume-average particle diameter (Dv) to a number-average particle diameter (Dn) thereof of from 1.00 to 2.25.

2. The toner of claim 1, wherein the toner has a ratio (Pv/Pn) of a volume-average particle diameter (Pv) thereof to a number-average particle diameter (Pn) thereof of from 1.00 to 1.28.

3. The toner of claim 2, wherein the toner has a spin-spin relaxation time (T2) of from 0.20 to 2.00 msec at 90° C. when subjected to Hahn echo method of NMR analysis.

4. The toner of claim 1, wherein the toner has a log G' of a storage elastic modulus (Pa) at 100° C. of from 3.5 to 4.5 in a dynamic viscoelasticity measured at a temperature sweep (swept from 40° C.), a frequency of 1 Hz, a distortion quantity control of 0.1%, and a programming rate of 2° C./min).

5. A two-component developer, comprising the toner according to claim 1 and a magnetic carrier.

6. The toner of claim 1, which comprises 10% to 85% by weight of the crystalline polyester resin.

7. The toner of claim 1, wherein the amorphous resin is a polyester resin.

8. The toner of claim 1, wherein the amorphous resin comprises a modified polyester resin and an unmodified polyester resin.

9. The toner of claim 1, wherein the ratio (Dv/Dn) of the volume-average particle diameter (Dv) to a number-average particle diameter (Dn) thereof is from 1.84 to 2.25.

10. The toner of claim 1, wherein the ratio (Dv/Dn) of the volume-average particle diameter (Dv) to a number-average particle diameter (Dn) thereof is from 1.71 to 2.25.

11. The toner of claim 1, wherein the toner has a glass transition temperature of 40° C. to 70° C.

12. The toner of claim 1, wherein the toner has a ratio (Pv/Pn) of a volume-average particle diameter (Pv) thereof to a number-average particle diameter (Pn) thereof of from 1.00 to 1.20.

13. The toner of claim 1, wherein the crystalline resin has a melting point of 50° C. to 100° C.

14. The toner of claim 1, further comprising resin particles.

15. The toner of claim 1, wherein the crystalline polyester resin has a weight average molecular weight (Mw) of 6,000 to 35,000.

16. The toner of claim 1, wherein the crystalline polyester resin comprises a crystalline aliphatic polyester resin.

17. A toner, comprising:

an amorphous resin; and a crystalline polyester resin dispersed in the amorphous resin, wherein the crystalline polyester resin has a volume-average particle diameter (Dv) of from 0.07 to 0.20 μm, and a ratio (Dv/Dn) of the volume-average particle diameter (Dv) to a number-average particle diameter (Dn) thereof of from 1.00 to 2.25; and wherein the toner has a spin-spin relaxation time (T2) of from 0.20 to 2.00 msec at 90° C. when subjected to Hahn echo method of NMR analysis.

18. The toner of claim 17, wherein the crystalline polyester resin is present in a micro crystalline polyester resin phase.

* * * * *